US007377759B2

(12) United States Patent
Ishizuki

(10) Patent No.: US 7,377,759 B2
(45) Date of Patent: May 27, 2008

(54) SCROLL FLUID MACHINE WITH A SELF-ROTATION-PREVENTING DEVICE HAVING EARS FOR AN ORBITING SCROLL

(75) Inventor: Yuki Ishizuki, Machida (JP)

(73) Assignee: Anest Iwata Corporation (JP)

( * ) Notice: Subject to any disclaimer, the term of this patent is extended or adjusted under 35 U.S.C. 154(b) by 0 days.

(21) Appl. No.: 11/725,355

(22) Filed: Mar. 19, 2007

(65) Prior Publication Data

US 2007/0231174 A1 Oct. 4, 2007

(30) Foreign Application Priority Data

Mar. 28, 2006 (JP) ..... 2006-086958

(51) Int. Cl.
*F03C 2/00* (2006.01)
*F04C 18/00* (2006.01)

(52) U.S. Cl. ..... 418/55.3; 418/55.1; 418/55.2; 464/102

(58) Field of Classification Search ..... 418/55.1–55.6, 418/57; 464/102
See application file for complete search history.

(56) References Cited

U.S. PATENT DOCUMENTS 3,802,809 A * 4/1974 Vulliez ..... 418/55.3
5,154,592 A * 10/1992 Ohtani et al. ..... 418/55.3
5,466,134 A * 11/1995 Shaffer et al. ..... 418/55.3
6,106,247 A * 8/2000 Wood ..... 418/55.3
7,044,722 B2 * 5/2006 Fujioka et al. ..... 418/55.3
7,201,568 B2 * 4/2007 Sakamoto et al. ..... 418/55.1

FOREIGN PATENT DOCUMENTS

JP 58030402 A * 2/1983
JP 2003097462 A * 4/2003
JP 2006-46078 A 2/2006

* cited by examiner

*Primary Examiner*—Theresa Trieu
(74) *Attorney, Agent, or Firm*—Skinner & Associates

(57) ABSTRACT

In a scroll fluid machine, an orbiting scroll is revolved with respect to a fixed scroll in a housing. A self-rotation-preventing device is provided to prevent the orbiting scroll from rotating on its own axis. The device comprises a pair of holders, one of which is disposed in an orbiting side and the other is disposed in the housing. The holder in the orbiting side comprises a bearing, a holding plate for holding the bearing and a plurality of ears. At least one of the ears is disposed within a circle passing through the centers of the holders around the center of the orbiting scroll.

5 Claims, 3 Drawing Sheets

SCROLL FLUID MACHINE WITH A SELF-ROTATION-PREVENTING DEVICE HAVING EARS FOR AN ORBITING SCROLL

BACKGROUND OF THE INVENTION

The present invention relates to a scroll fluid machine such as a scroll vacuum pump or a scroll compressor.

A scroll fluid machine comprises a housing; a driving shaft having an eccentric axial portion and connected to a driving source, a fixed scroll fixed to the housing and an orbiting scroll which engages with the fixed scroll to form a compression chamber between the fixed and orbiting scrolls. The orbiting scroll is revolved to allow the compression chamber to be reduced in volume toward the center and to enable a gas therein to be compressed.

In JP2006-46078A, between the fixed and orbiting scrolls, a self-rotation preventing device is interposed to allow the orbiting scroll to revolve while it prevents the orbiting scroll from rotating on its own axis. The self-rotation driving device comprises a holder on the outer circumference of the orbiting scroll; a bearing in the holder; a holding plate for holding the bearing in the holder; and a pin crank in which one shaft is rotatably mounted on the bearing while the other shaft is rotatably mounted in the housing.

In the scroll fluid machine, when the orbiting scroll is revolved, excessive load acts to the pin crank in a centrifugal direction when the orbiting scroll is revolved to cause the holding plate to be deformed to make the bearing held unstably. Unstable holding of the bearing makes revolution of the orbiting scroll unstable, so that operation is likely to be inactive. Thus, the holding plate needs to be fixed to the orbiting scroll firmly.

SUMMARY OF THE INVENTION

In view of the disadvantages, it is an object of the invention to provide a scroll fluid machine comprising a self-rotation-preventing device for preventing an orbiting scroll to rotate on its own axis, a holding plate for the device being fixed to a holder for the orbiting scroll firmly to enable the orbiting scroll to revolve stably.

BRIEF DESCRIPTION OF THE DRAWINGS

The features and advantages will become more apparent from the following description with respect to an embodiment as shown in accompanying drawings wherein.

DETAILED DESCRIPTION OF PREFERRED EMBODIMENTS

Figure 1:
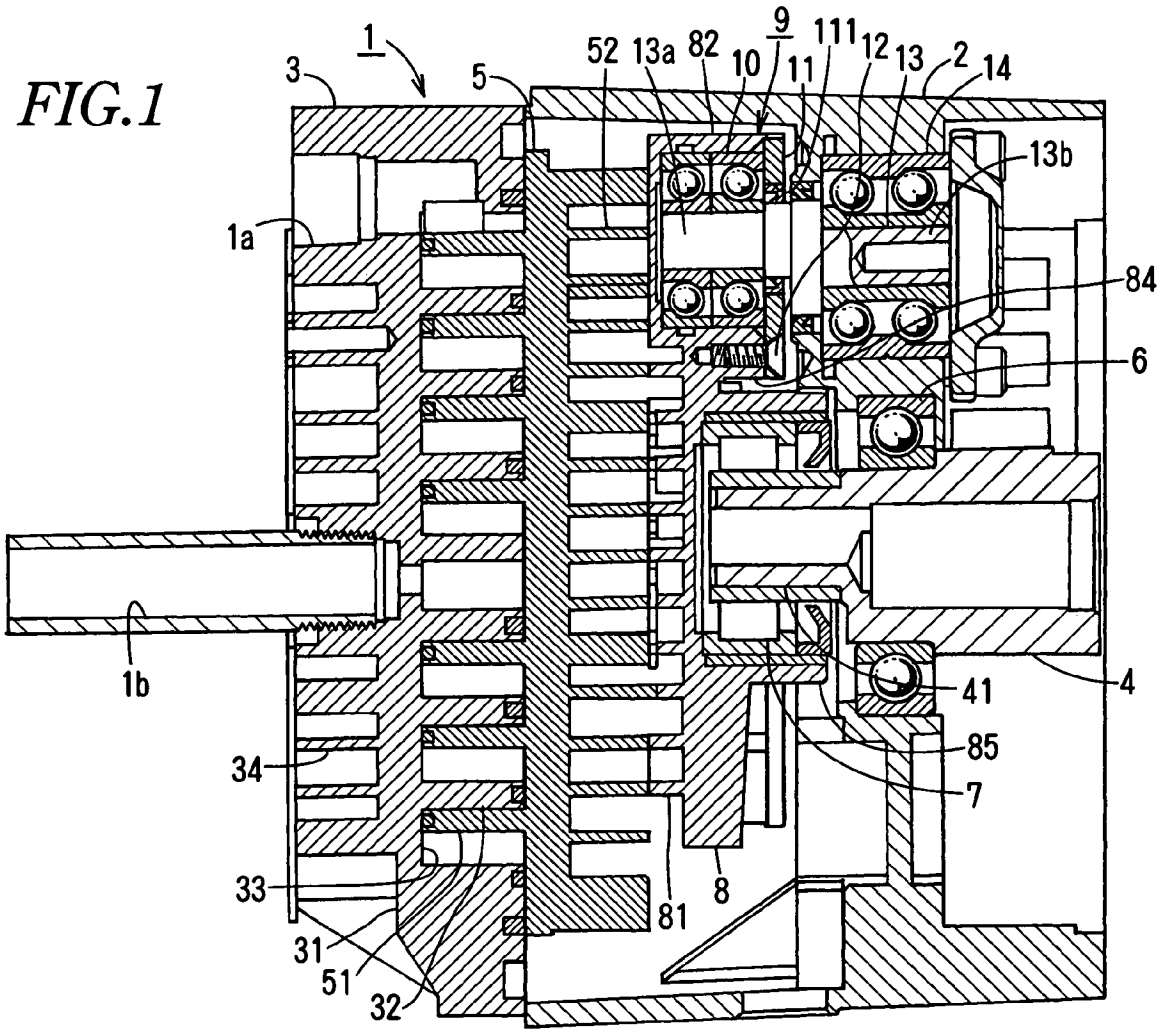
FIG. 1 is a vertical sectional view of an embodiment of a scroll fluid machine according to the present invention.

A housing 1 comprises a rear casing 2 and a front cover 3 to form a sealed chamber therebetween. In the outer circumference there is a sucking port 1*a* for sucking external gas in the sealed chamber and a discharge port for discharging gas compressed in the sealed chamber.

The cover 3 comprises a fixed end plate 31 having a plurality of cooling fins 34 which horizontally extend. On the rear surface of the fixed end plate 31, a spiral or involute-curve fixed wrap 32 is formed to constitute fixed scroll 33. The cooling fin 34 is corrugated along horizontal flow of cooling wind.

In the sealed chamber between the casing 2 and the cover 3, an orbiting scroll 5 is rotatably secured around an eccentric axial portion 41 of a driving shaft 4 at the center of the housing 2.

When the driving shaft 4 is rotated by a motor, the orbiting scroll 5 is revolved thereby reducing a compression chamber between the fixed wrap 32 and an orbiting wrap 51 in volume. Thus, a gas sucked in through the sucking port 1*a* is compressed and finally discharged through the discharge port 1*b*.

The driving shaft 4 is joined at the rear end to the motor (not shown) as driving source and is rotatably mounted at the center of the housing 2 via a bearing 6.

On the front surface, the orbiting scroll 5 comprises the orbiting wrap 51 which engages with the fixed wrap 32 which is shifted from the orbiting wrap 51 by 180 degrees. Behind the orbiting scroll 5, an orbiting-assisting plate 8 is fixed.

On the rear surface of the orbiting scroll 5 facing the front surface of the orbiting-assisting plate 8, a plurality of cooling fins 52 which extend horizontally are vertically spaced from each other. On the front surface of the orbiting-assisting plate 8, a plurality of fins 81 are formed similar to the cooling fins 52 on the fixed scroll 5. Cooling wind flows horizontally along the cooling fins 52,81 on the rear surface of the orbiting scroll 5 and the front surface of the orbiting-assisting plate 8.

The orbiting-assisting plate 8 is rotatably mounted around the eccentric axial portion 41 of the driving shaft 4 via a bearing 7 and connected to the casing 2 via three self-rotation preventing devices 9 equally spaced circumferentially.

The self-rotation preventing devices 9 allow the orbiting scroll 5 to be revolved while preventing the orbiting scroll 5 from rotating on its own axis. Each of the self-rotation-preventing devices 9 comprises a holder 82 on the orbiting-assisting plate 8; a ball bearing 10 in the holder 82; a holding plate 11 for fixing the ball bearing 10 in the holder 82 by screwing a bolt 12 in a plurality of ears 84 around the holder 82; and a pin crank 13.

In the embodiment, the holder 82 is provided on the orbiting-assisting plate 8 fixed to the rear surface of the orbiting scroll 5. The present invention is not limited to the holder 82, but a holder may be formed on an orbiting scroll which is integrally formed with an orbiting-assisting plate.

The pin crank 13 comprises an orbiting-side shaft 13*a* rotatably supported on the ball bearing 10 in the holder 82 of the orbiting-assisting plate 8; and a fixing side shaft 13*b* rotatably supported on a ball bearing 14 in the casing 2. The orbiting-side shaft 13*a* and fixing-side shaft 13*b* have eccentric distance equal to an eccentric axial portion 41 of the driving shaft 4.

The holders 82 are formed on the same outer circumference of the orbiting-assisting plate 8, open at the rear ends and have the ball bearings 10.

Figure 2:
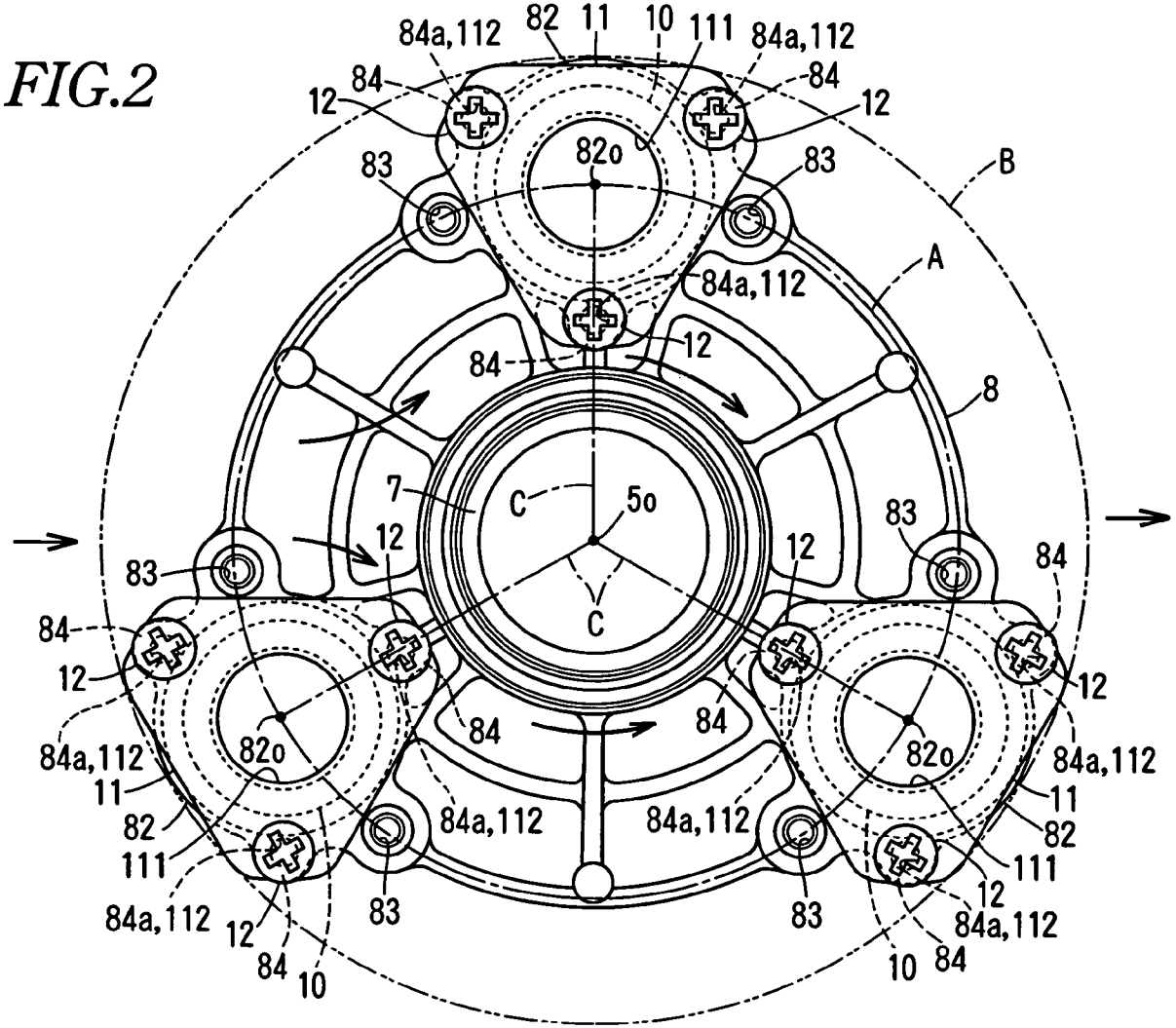
FIG. 2 is a rear elevational view of an orbiting-assisting plate provided behind an orbiting scroll.
Figure 3:
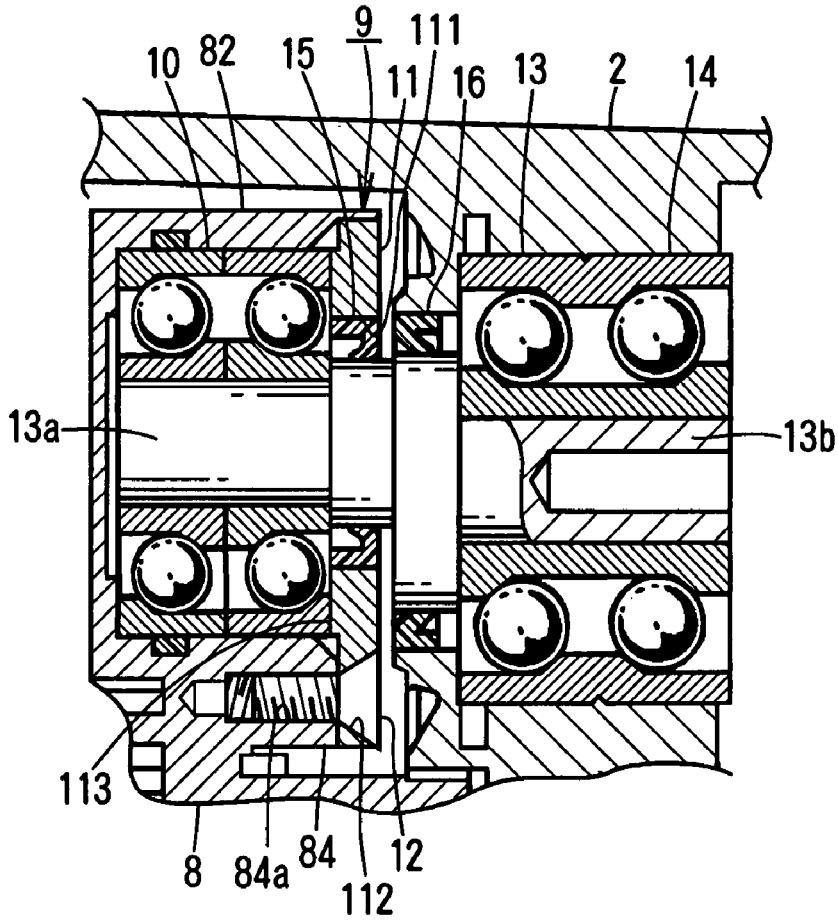
FIG. 3 is an enlarged vertical sectional view of main part.

In FIG. 2, around the holder 82, there are two bores 83 in which a bolt (not shown) is put for fixing the orbiting-assisting plate 8 to the rear part of the orbiting scroll 5; and the three ears 84 each of which has a female thread 84*a* with which the bolt 12 engages for fixing the holding plate 11 to the rear part of the holder 82. The ears 84 are spaced by 120 degrees around the holder 82.

In FIG. 2, two of the three ears 84 are disposed outside the first circle A passing through the centers 82*o* of the holders

82 around the center 5*o* of the orbiting scroll 5, while one of the three ears 84 is disposed inside the first circle A. All the ears 84 are disposed inside the second circle B in contact with a radially outermost portion of the holder 82 around the center 5*o* of the orbiting scroll 5. Each of the ears 84 within the first circle A is disposed on a straight line C connecting the center 5*o* of the orbiting scroll 5 to the center 82*o* of the holder 82.

The holding plate 11 comprises almost an equilateral triangle having rounded corners. The holding plate 11 has a central hole 111 through which the orbiting-side shaft 13*a* of the pin crank 13 passes and three bores 112 around the central hole 111 corresponding to the female threads 84*a* of the orbiting-assisting plate 8.

Thus, the bolt 12 passes through the hole 112 to engage in the female thread 84*a* thereby allowing the holding plate 11 to be fixed on the rear surface of the holder 82 to support the ball bearing 10 in the holder 82, On the front surface around the central hole 111 of the holding plate 11, an annular projection 113 is provided to improve rigidity.

Around the pin crank 13, sealing members 15, 16 are interposed to seal a gap between the central hole 111 of the holding plate 11 and the casing 2.

As mentioned above, the two ears 84 are disposed outside the first circle A passing through the centers 82*o* of the holders 81 around the center 5*o* of the orbiting scroll 5, while the one ear 84 is disposed inside the first circle A. Thus, when the orbiting scroll 5 is revolved, the holding plate 11 can be effectively received by the bolts 12 inserted in the two outside ears 84 with respect to centrifugal load acting to the pin crank 13 thereby preventing the pin crank 13 from falling off to enable the orbiting scroll 5 to be revolved stably.

All of the three ears 84 are disposed within the second circle B in contact with the radially outermost portion of the holders 82 around the center 5*o* of the orbiting-assisting plate 8 or orbiting scroll 5. Thus, all the ears 84 are prevented from projecting from the outer circumference of the orbiting scroll 5 or outside the second circle B, thereby reducing a diameter of the orbiting scroll 5 and making the housing 1 smaller.

The ear 84 inside the first circle A is disposed on the straight line C between the center 5*o* of the orbiting-assisting plate 8 or orbiting scroll 5 and the center 82*o* of the holder 82 thereby fixing the holding plate 11 to the holder 82 more firmly.

Furthermore, cooling wind flows horizontally along the cooling fins 52,81 between the orbiting scroll 5 and the orbiting-assisting plate 8 and flows behind the orbiting-assisting plate 8 along the outer circumferential surfaces of the holders 82 and a boss 85 without obstacle of the ears 84 thereby cooling the ball bearing 10, the sealing members 15, 16 and the bearing 7 effectively.

The foregoing embodiment relates to a one-side scroll fluid machine in which the one-side fixed scroll 33 engages with the one-side orbiting scroll 5, but the present invention also applies to a both-side scroll fluid machine in which a both-side orbiting scroll is disposed between two fixed scrolls.

The foregoing merely relates to an embodiment of the invention. Various changes and modifications may be made by a person skilled in the art without departing from the scope of claims wherein:

What is claimed is:

1. A scroll fluid machine comprising:

a housing;

a driving shaft having an eccentric axial portion;

a fixed scroll fixed to the housing;

an orbiting scroll rotatably secured around the eccentric axial portion of the driving shaft, the orbiting scroll engaging with the fixed scroll to form a compression chamber between the fixed and orbiting scrolls; and a self-rotation-preventing device that allows the orbiting scroll to revolve while the device prevents the orbiting scroll to rotate on its own axis, said self-rotation-preventing device comprising a pair of holders one of which is fixed in the housing, the other being fixed in an orbiting side, each of the holders comprising a bearing and a shaft rotatably supported in the bearing, the shaft being connected to the other shaft to constitute a pin crank, the holder of the orbiting side comprising a plurality of ears and a holding plate that holds the bearing in the holder, two of the ears being disposed outside a first circle which passes through a center of the holder around a center of the orbiting scroll, one of the ears being disposed inside the first circle.

2. A scroll fluid machine of claim 1 wherein all the ears are disposed inside a second circle in contact with a radially outermost portion of the holder around the center of the orbiting scroll.

3. A scroll fluid machine of claim 1 wherein the ear inside the first circle is disposed on a straight line between the center of the orbiting scroll and the center of the holder.

4. A scroll fluid machine of claim 1, further comprising an orbiting-assisting plate fixed to a rear surface of the orbiting scroll, the holder in an orbiting side being disposed in the orbiting-assisting plate.

5. A scroll fluid machine of claim 4 wherein a plurality of self-rotation-preventing devices are provided on an outer circumference of the orbiting-assisting plate, each of the holders being almost equilateral triangle in which each of the ears is disposed at an apex, one the ears being within the first circle.

* * * * *